US006059006A

United States Patent [19]

Rossini

[11] Patent Number: 6,059,006

[45] Date of Patent: May 9, 2000

[54] ACTUATION DEVICE FOR A VENETIAN BLIND OR THE LIKE ARRANGED INSIDE A DOUBLE-GLAZING UNIT

[75] Inventor: Mauro Rossini, Este, Italy

[73] Assignee: Finvetro S.r.l., Este, Italy

[21] Appl. No.: 09/148,880

[22] Filed: Sep. 8, 1998

[30] Foreign Application Priority Data

Sep. 15, 1997 [IT] Italy ..... PD970063 U

[51] Int. Cl.[7] ..... E06B 9/264

[52] U.S. Cl. ..... 160/107; 160/176.1 R; 49/82.1

[58] Field of Search ..... 160/107, 176.1 R, 160/177 R; 49/82.1, 64, 86.1

[56] References Cited

U.S. PATENT DOCUMENTS

| | | | |
|---|---|---|---|
| 3,201,832 | 8/1965 | Hordis et al. | 49/64 |
| 3,253,644 | 5/1966 | Gotoh et al. | 160/107 |
| 3,722,572 | 3/1973 | Hall | 160/107 |
| 4,685,502 | 8/1987 | Spangenberg | 160/176.1 R X |
| 4,687,040 | 8/1987 | Ball | 160/107 X |
| 4,917,167 | 4/1990 | Voss et al. | 160/107 X |
| 5,107,916 | 4/1992 | Roermund et al. | 160/177 R X |
| 5,396,944 | 3/1995 | Rossini | 160/107 |
| 5,699,845 | 12/1997 | Jelic | 160/107 |
| 5,769,142 | 6/1998 | Nicolosi | 160/107 |

FOREIGN PATENT DOCUMENTS

| | | |
|---|---|---|
| 0 319 601 | 6/1989 | European Pat. Off. . |
| 0 611 873 | 8/1994 | European Pat. Off. . |
| 2921 608 | 12/1980 | Germany . |
| 95 24 539 | 9/1995 | WIPO . |

*Primary Examiner*—David M. Purol
*Attorney, Agent, or Firm*—Guido Modiano; Albert Josif

[57] ABSTRACT

An actuation device for a Venetian blind or the like arranged inside a double-glazing unit comprises a first magnet, which is arranged inside the double-glazing unit and is directly connected to the respective actuation system, and a second external magnet. The second magnet is associated, in a box-like structure which is applied horizontally on the outside of the double-glazing unit, with a kinematic element extending between two end elements, one of which is arranged on an actuation rod which can rotate about its own axis.

5 Claims, 2 Drawing Sheets

ACTUATION DEVICE FOR A VENETIAN BLIND OR THE LIKE ARRANGED INSIDE A DOUBLE-GLAZING UNIT

BACKGROUND OF THE INVENTION

The present invention relates to an actuation device for a Venetian blind or the like arranged inside a double-glazing unit.

Venetian blinds or the like arranged inside a double-glazing unit with magnet-type actuation means are already known, wherein the blind is accommodated in the hermetic interspace formed between the two glazed surfaces of the double-glazing unit and is actuated, as regards the adjustment of the packing and/or inclination of its slats, by means of a magnetic coupling, through one of the glazed surfaces, between a first internal magnet, which is directly connected to respective actuation systems, and a second external magnet.

The internal mechanical devices are constructed so that they are actuated by means of a straight-line translatory motion of the magnets.

In home installations, actuation is mostly manual: the user moves the second magnet in a straight line along the border of the double-glazing unit inside which the first magnet is arranged.

There are vertically-arranged actuations and actuations which are mostly adapted only to adjust the inclination of the slats of the double-glazing unit which are arranged on the horizontal upper border, mainly due to aesthetic impact concerns, and are therefore not particularly handy, especially for short people.

SUMMARY OF THE INVENTION

The aim of the present invention is to provide an actuation device for a Venetian blind arranged inside a double-glazing unit which eliminates the drawback described above in conventional types.

A consequent primary object is to provide an actuation device in which the part that can break or malfunction lies outside the double-glazing unit and can be replaced simply and quickly.

Another important object is to provide an actuation device which can be easily applied even to existing double-glazing units.

Another object is to provide an actuation device which has a simple structure and a low cost.

This aim, these objects and others which will become apparent hereinafter are achieved by an actuation device for a Venetian blind or the like arranged inside a double-glazing unit of the type comprising a first magnet, which is arranged inside the double-glazing unit and is directly connected to the respective actuation system, and a second external magnet, said device being characterized in that said second magnet is associated, in a box-like structure applied horizontally to the outside of the double-glazing unit, to a flexible element which is stretched in a loop between two guiding elements, one of which is arranged on an actuation rod which can rotate about its own axis.

BRIEF DESCRIPTION OF THE DRAWINGS

Further characteristics and advantages of the present invention will become apparent from the following detailed description of an embodiment thereof, illustrated only by way of non-limitative example in the accompanying drawings, wherein.

DESCRIPTION OF THE PREFERRED EMBODIMENTS

Figures 1, 2:
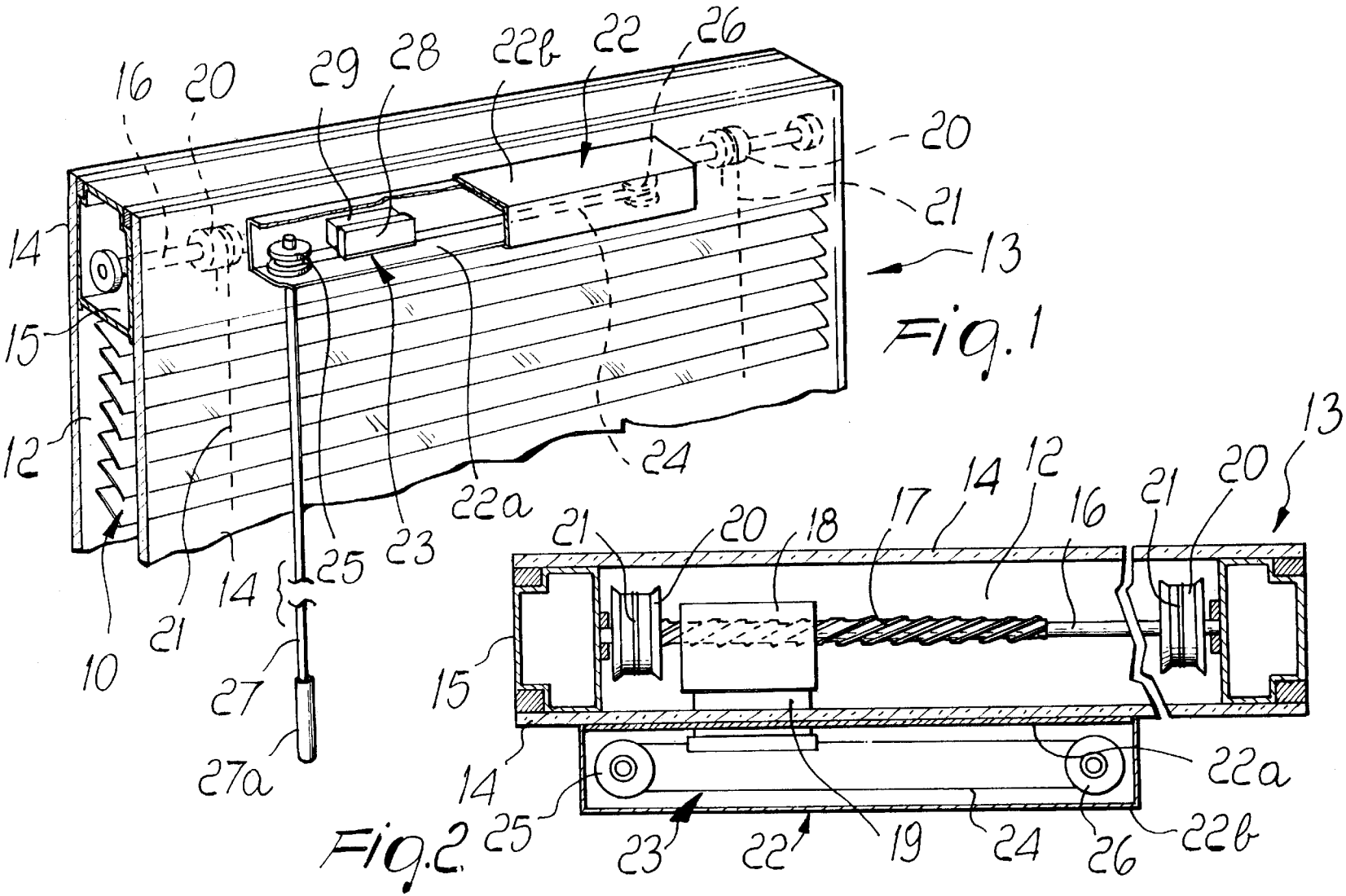
FIG. 1 is a perspective view, partly in phantom lines, of the upper part of a double-glazing unit which internally accommodates a Venetian blind.
FIG. 2 is a sectional view, taken along a horizontal plane, of the region related to the actuation device according to the present invention.

With reference to FIGS. 1 and 2, a Venetian blind is designated by the reference numeral 10 and comprises a plurality of slats which are connected to the upper side of the framework 15 of the double-glazing unit 13 in which the Venetian blind 10 is inserted.

Conventionally, the double-glazing unit 13 is substantially constituted by a pair of glazed surfaces 14 which are mutually spaced by an aluminum framework 15 which is hermetically coupled thereto by sealing.

The Venetian blind 10 has means for adjusting the inclination of the slats comprising a shaft 16 which is rotatably connected to the framework 15 and has a helical median portion 17.

As shown in the figures, the shaft 16 is arranged inside the horizontal upper portion of the frame 15.

A bush 18 is connected to the median portion 17 of the shaft 16 and is internally shaped complementarily to the helical profile; a first magnet 19 is fixed to said bush, also rests internally on the corresponding glazed surface 14, and is slidingly coupled thereon.

Pulley-type supports 20 are also fixed to the shaft 16; the cords 21 surround said supports and, through their vertical movement, synchronously turn all the slats of the Venetian blind 10 about a longitudinal axis thereof.

On the outside of the double-glazing unit 13, in a box-like structure 22 which is fixed thereto by means of double-adhesive or other movable systems, a kinematic system 23 is provided and is composed of a flexible element, such as a cord 24, which is stretched in a loop between two pulley-type guiding elements which have a vertical axis and are designated respectively by the reference numerals 25 and 26; the first guiding element is arranged on an actuation rod 27 which protrudes downward and is rotatable about its own axis.

The cord 24 surrounds several times the first pulley 25 in order to avoid slippage during actuation.

A second magnet 29 is fixed to the cord 24, either directly or by means of a support 28, and is coupled to said first magnet 19 through the glazed surface 14.

The box-like structure 22 is conveniently composed of two complementarily shaped profiles 22*a* and 22*b* which are substantially C-shaped; the first profile is fixed, as mentioned, to the double-glazing unit 13 and rotatably supports the pulleys 25 and 26, while the second profile acts as a covering which can be coupled by snap action onto the first profile by way of interlocking elements which are not shown in the figures.

The actuation rod 27 has a length which makes it available, in a downward region, to the action of the user at a region where a grip knob 27*a* is provided.

In practice, by actuating the rod 27 the cord 24 is moved, accordingly producing a translatory motion of the magnets 29 and 19 and of the bush 18 and a rotation of the shaft 16.

This entails a movement of the cords 21 and therefore a variation in the inclination of the slats of the blind 10.

Since the kinematic actuation system is arranged outside the double-glazing unit 13, it can be easily replaced or repaired in case of breakage or malfunction simply by disconnecting the box-like structure 22 from the rest.

It should also be observed that the kinematic system used for the movement for adjusting the inclination can also be used to adjust the packing of the blind or, if said blind is constituted by a sheet, its rolling-up; in this case, however, it is convenient to provide the rod 27 with a crank-shaped lower end to facilitate the maneuver, which entails a considerable number of turns.

Figure 4:
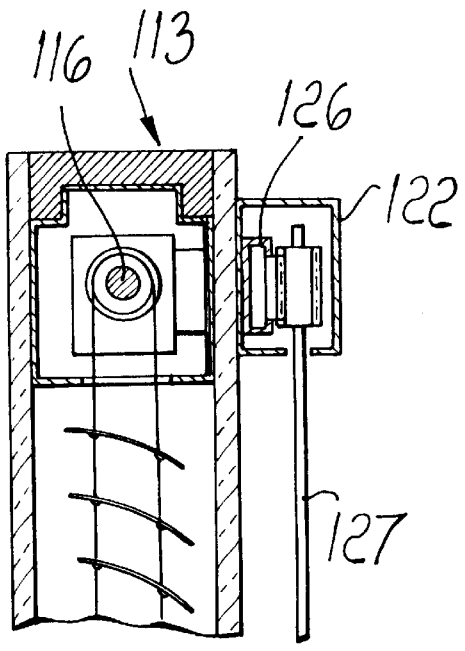
FIG. 4 is a sectional view, taken along a longitudinal plane, of the upper part of the double-glazing unit of FIG. 3.
Figure 5:
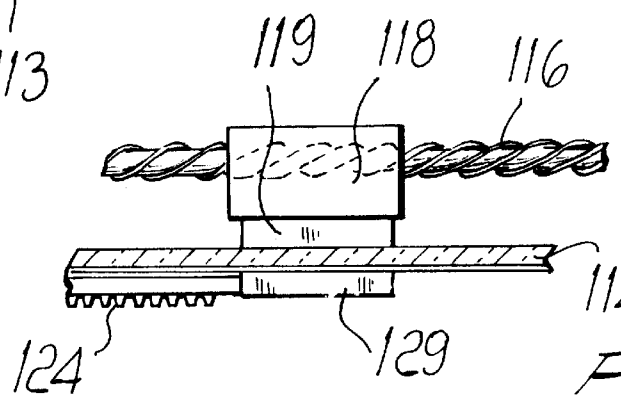
FIG. 5 is a top view of a detail of the actuation device shown in FIG. 3.
Figure 3:
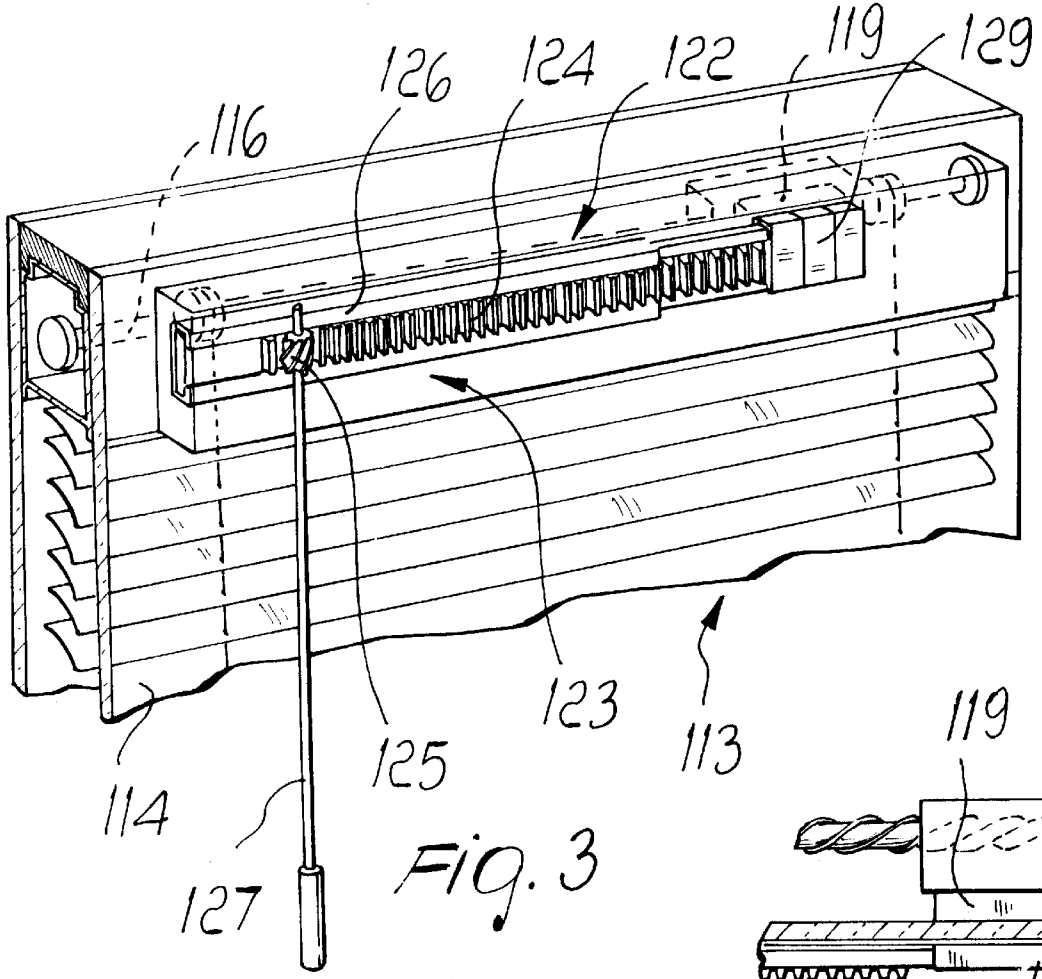
FIG. 3 is a perspective view, partly in phantom lines, of the upper part of a double-glazing unit which internally accommodates a Venetian blind with a further embodiment of the actuation device according to the present invention.

In a further embodiment, shown in FIGS. 3, 4 and 5, a Venetian blind 110 has adjustment means which comprise, in this case, on the outside of the double-glazing unit, now designated by the reference numeral 113, and inside a box-like structure 122 which is fixed to said unit by means of a double-adhesive element or other removable fixing systems, a kinematic system 123 which is composed of a rack 124 which is parallel to the shaft, now designated by the reference numeral 116, and is supported by a C-shaped guide 126.

A pinion 125 is coupled to said rack 124 and is associated, at one end, with an actuation rod 127 which protrudes downwards and can rotate about its own axis.

In this case, a second magnet 129 is associated with one end of said rack 124 and is coupled to the first magnet, now designated by the reference numeral 119, through the glazed surface 114.

Conveniently, the first magnet 119 is fixed to the bush, now designated by the reference numeral 118, which is internally shaped complementarily to the helical profile of the shaft 116.

Still another embodiment can be provided by arranging, inside the box-like structure, a kinematic system which is composed of a worm screw coupled to a nut, arranging the worm screw so that it is parallel to the shaft and associating the actuation rod with the nut.

In this manner, the movement produced by the actuation of the nut on the worm screw must be transmitted, by means of an adapted transducer, to the second magnet and, by means of the magnetic coupling, to the first magnet.

In practice it has been observed that the intended aim and objects of the present invention have been achieved. In practice, the materials employed, so long as they are compatible with the contingent use, as well as the dimensions, may be any according to requirements.

The disclosures in Italian Utility Model Application No. PD97U000063 from which this application claims priority are incorporated herein by reference.

What is claimed is:

1. An actuation device connected with a blind arranged inside a hermetically sealed space of a double-glazing unit comprising:

an actuation system for adjusting the blind;

a first magnet, which is arranged inside said hermetically sealed space of the double-glazing unit and is directly connected to said actuation system;

a box-like body connected outside said double-glazing unit;

a second magnet located inside said box-like body so as to cooperate with said first magnet such that when said second magnet moves said first magnet moves correspondingly to activate said actuation system for adjusting the blind;

a kinematic element for driving said second magnet, said kinematic element comprising a cord which supports said second magnet and which is stretched in a loop between two pulley-type guiding end elements having vertical axes; and an actuation rod which is rotatable about its own axis, said actuation rod being drivingly connected to one of said, pulley-type guiding end elements.

2. The device of claim 1, wherein said box-like structure is composed of two substantially C-shaped complementary profiles, with a first profile thereof being detachably fixed to the double-glazing unit and rotatably supporting said pulley-type guiding elements, and the second profile acting as a covering element which is connected to the first profile.

3. The device of claim 2, wherein said first magnet is slidingly movable inside said hermetically sealed space of said double-glazing unit, said actuation system comprising: a shaft provided with a helical profile and lying inside said hermetically sealed space of said double-glazing unit, and a bush which is internally provided with a helical profile which is shaped complementarily with respect to the helical profile of a corresponding portion of said shaft, said first magnet being connected to said bush.

4. The device of claim 3, further comprising: adjustment cords for the adjustment of the inclination of slats of said blind which are keyed to said shaft, and pulley-type supports supported by said shaft for winding said adjustment cords.

5. An actuation device connected with a blind arranged inside a hermetically sealed space of a double-glazing unit comprising:

an actuation system for adjusting the blind;

a first magnet, which is arranged inside said hermetically sealed space of the double-glazing unit and is directly connected to said actuation system;

a box-like body connected outside said double-glazing unit;

a second magnet located inside said box-like body so as to cooperate with said first magnet such that when said second magnet moves said first magnet moves correspondingly to activate said actuation system for adjusting the blind;

a kinematic system for driving said second magnet, said kinematic system comprising a rack and a pinion, said rack having a first end with which said second magnet is connected, and said pinion engaging said rack at a second end of said rack; and an actuation rod which is rotatable about its own axis and is drivingly connected with said pinion.

* * * * *